US005370254A

United States Patent [19]

Hardigg et al.

[11] Patent Number: 5,370,254

[45] Date of Patent: Dec. 6, 1994

[54] HINGE AND LATCHING MECHANISM FOR CONTAINERS

[75] Inventors: James S. Hardigg, Conway; George R. Havrilla, Whatley; Stanley W. Lewandowski, Jr., Shelburne, all of Mass.

[73] Assignee: Hardigg Industries, Inc., South Deerfield, Mass.

[21] Appl. No.: 957,728

[22] Filed: Oct. 7, 1992

[51] Int. Cl.[5] ..... B65D 6/00

[52] U.S. Cl. ..... 220/4.22; 220/325; 220/343; 220/344; 16/252; 16/390; 16/DIG. 13

[58] Field of Search ..... 220/4.22, 324, 325, 220/342, 343, 344; 16/221, 252, 390, DIG. 13; 292/109, 110, 336.3, DIG. 38

[56] References Cited

U.S. PATENT DOCUMENTS

| | | | |
|---|---|---|---|
| 1,912,850 | 6/1933 | Kuck et al. | 220/325 X |
| 2,040,191 | 5/1936 | Wanders | 220/342 X |
| 3,317,078 | 5/1967 | Gordon | 220/342 |
| 3,355,088 | 11/1967 | Young | 220/342 X |
| 3,468,577 | 9/1969 | Winston et al. | 220/325 X |
| 3,612,590 | 10/1971 | Andreini | 16/221 X |
| 4,205,762 | 6/1980 | Wolfseder | 220/334 |
| 4,284,202 | 8/1981 | Barstow, Jr. | 220/324 X |
| 4,546,874 | 10/1985 | Kirchhan | 220/4.22 |
| 4,915,913 | 4/1990 | Williams et al. | 220/324 X |

*Primary Examiner*—Allan N. Shoap
*Assistant Examiner*—Stephen Cronin
*Attorney, Agent, or Firm*—Fishman, Dionne & Cantor

[57] ABSTRACT

Hinge and latching mechanism for containers having a cover and a base includes a latch which, at its upper portion, is shaped to hook over a strike integrally disposed on the cover. The lower portion of the latch rotates about a pin located between a pair of feet which are provided with hooks to engage a flange extending from a lip on the base. The hinge includes a body and two legs and the former is also shaped to securely engage a second strike also located on the cover. Each leg has a foot which is also hooked to engage the flange of the base. To further secure the hinge and latch, each hook is fastened together and to the container. This structure ensures that hinge and latching mechanism are especially adapted for heavy duty applications while still being light in weight and small in size.

8 Claims, 3 Drawing Sheets

HINGE AND LATCHING MECHANISM FOR CONTAINERS

BACKGROUND OF THE INVENTION

This invention relates generally to hinges and fasteners for containers and more particularly to hinge and latching mechanisms for use with heavy duty type containers.

In military and heavy duty commercial applications, it is advantageous to provide as sturdy but yet as light in weight as possible a container while still providing one that is cost effective. In accordance with this, containers used by the military for transporting sensitive electronic equipment have been manufactured by both injection molding and roto-molding. These containers may be provided with a tongue and groove seal between the mating surfaces of the container to protect against water damage and the like to the contents. In addition, in order to ensure proper fit when the containers are stacked and stored together and to ensure that the hinges and latches are protected during drops and other abuse the containers are sculpted or inset where the latches and hinges are mounted. In order to minimize the size of the sculpted portions and thereby increase the inside volume of the container, the hinges and latches must be as compact as possible.

A problem arises with prior art hinges and fasteners, currently provided for the above-described containers, which pertains to the size, weight and cost thereof. A typical strap hinge includes flat plates which are mounted in juxtaposition to the body and then pinned or riveted. To prevent breakage in heavy duty type applications, the hinge is typically formed of a metallic substance thereby increasing cost and weight. Latching mechanisms which have a latch and a strike are also formed of a metallic substance and both are mounted, similar to the strap hinges, in juxtaposition to the container and then riveted.

Another problem arises regarding the manner in which the hinges and fasteners are riveted to the container. Currently, the straps are riveted such that the rivets pierce the integrity of the container increasing the possibility of leakage.

SUMMARY OF THE INVENTION

The above-discussed and other problems and deficiencies of the prior art are overcome or alleviated by providing a lightweight and compact hinge and latching mechanism capable of use in military and heavy duty commercial type applications. In accordance with the present invention, a hinge and latching mechanism are adapted to engage a strike and a flange disposed adjacent the mating surfaces of a container. The mechanisms are provided with hooks to more securely grip each half of the container.

In addition, the hinge and latching mechanisms of the present invention achieve lower cost and lighter weight by the use of molded plastic materials.

Another feature of the present invention involves the use of the cover of the container to provide an integrally molded strike means for the latching mechanism thereby reducing weight, assembly time and cost.

Still another feature of the present invention involves mounting the hinge and latching mechanism to a flange and a strike rather than to the container body to prevent loss of the integrity of the container.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 2:
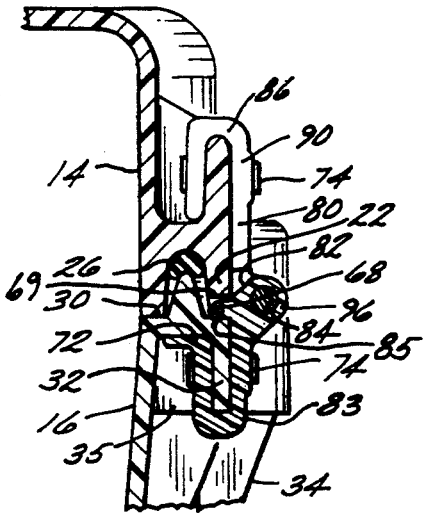
FIG. 2 is a cross-sectional elevational view taken along line 2—2 of FIG. 1.
Figure 1:
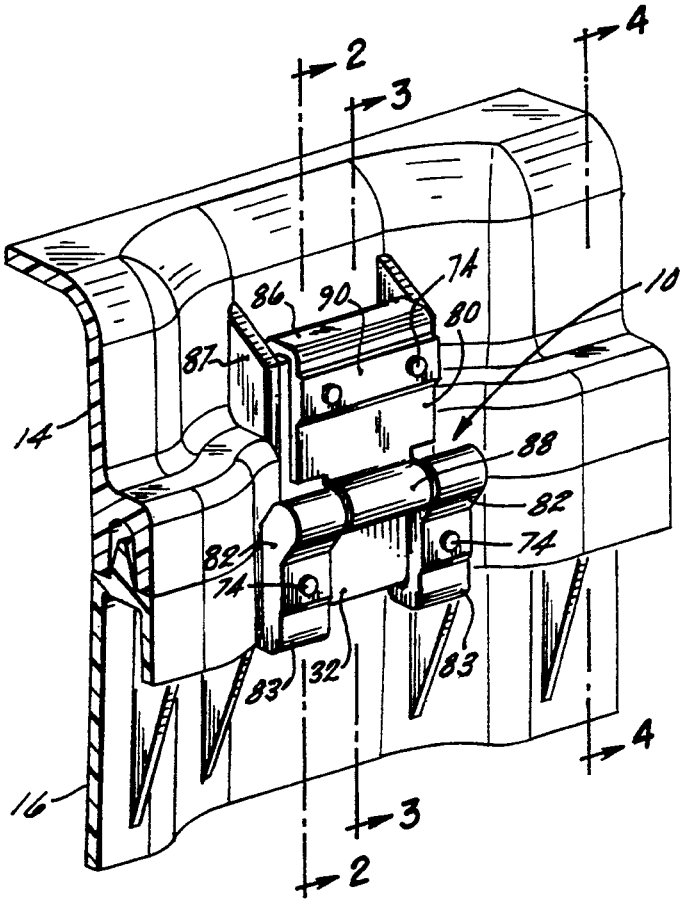
FIG. 1 is a perspective view of a hinge in accordance with the present invention and mounted to a section of a container.
Figure 4:
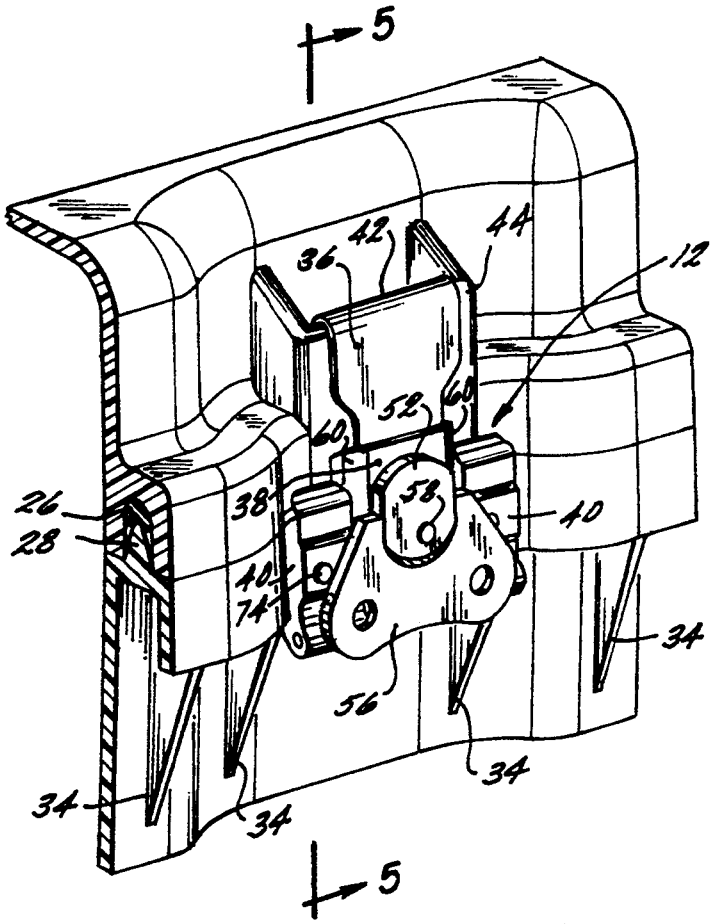
FIG. 4 is a perspective view of a latching mechanism in accordance with the present invention and mounted to a section of a container.

Referring first to FIG. 1, the hinge of the present invention is shown generally at 10. As illustrated best in FIG. 4, the latching mechanism of the present invention is shown generally at 12. The latching mechanism 12 is mounted to an injection molded container 13 having a cover 14 and a base 16 which are mated together along seal 18. Both the cover 14 and base 16 includes a sculpted or inset portion 20 which is provided to prevent the latching mechanism 12 from interfering in the storage of a pluralty of containers in juxtaposition to each other and to protect the hinges and latches during drops and other abuse. Lip 22 of cover 14 has a groove 24 which is disposed about the periphery of the mating surface thereof. Located within the groove 24 is a tubular or cellular sealing member 26 which, when the container 13 is closed, is engaged by tongue 28 that extends from a lip 30 of the base 16. Flange 32 extends downwardly from lip 30 and support members 34 and webbings 35 (FIG. 2) are provided to prevent movement of the flange 32 and to provide lateral support to a pair of feet 40.

Figure 5:
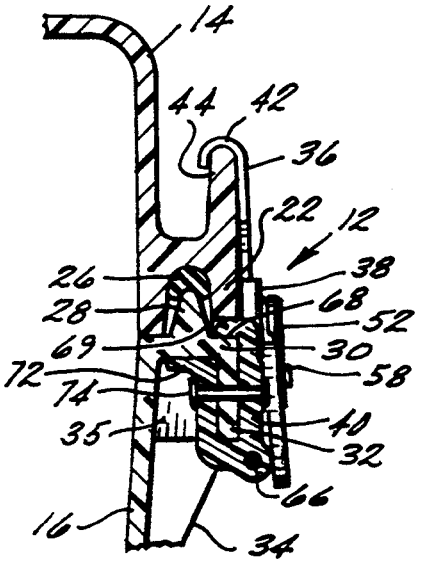
FIG. 5 is a cross-sectional elevational view taken along line 5—5 of FIG. 4.

Latching mechanism 12 may be formed of any suitably strong material and includes a latch 36, a housing 38 and feet 40. The latch 36 and housing 38 are well known and are available from the Southco., Inc. of Philadelphia, Pa. Latch 36 is slidably disposed within housing 38 and includes a hooked upper portion 42 which is adapted to engage a strike 44. Referring also to FIG. 5, strike 44 may be formed integrally with cover 14 and extends upwardly from lip 22 and is secured to the cover 14 by stabilizing members 46.

Housing 38 includes a cam 52 and a sleeve through which a hinge pin extends. Cam 52 is mounted perpendicularly through the longitudinal direction of housing 38 and handle 56 is mounted thereon. Pin 58 is also mounted on cam 52 but on an eccentric axis and, when mounted, extends through latch 36 for manipulation thereof. Flanges 60 are provided to retain latch 36 which slides therethrough when manipulated by handle 56. Handle 56 is pivotally mounted to cam 52 in a manner whereby the handle may be moved from a generally parallel position to the latch 36 (FIG. 4) to a perpendicular position (not shown) for manipulation by hand. To close the container, handle 56 is rotated clockwise causing latch 36 to slide downwardly through housing 38 and engage strike 44. To open the container, the handle 56 is rotated counter clockwise until the latch 36 disengages the strike 44.

Figure 5A:
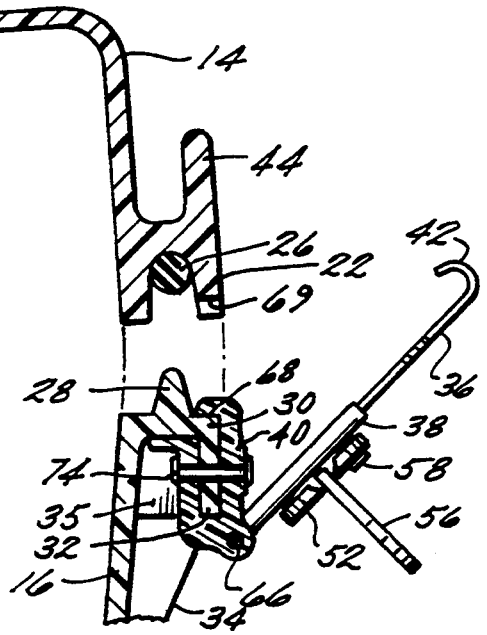
FIG. 5A is a cross-sectional elevational view taken along line 5A—5A with the cover and base separated and the latch removed.

Feet 40 may be formed of any suitably strong but light in weight material, such as a polycarbonate plastic, and are shaped to receive the lower edge of flange 32. Each foot 40 is adapted to accept one end of the hinge pin 66 so the latch 36 and housing 38 may rotate about the hinge pin for engaging and disengaging from strike 44. The feet 40 are also spaced apart so as to admit the housing 38 therebetween when the latch engages the cover 14 and are disposed between webbing 35. Referring also to FIG. 5A, toe 68 is provided to engage the upper edge of lip 30 and lip 22 is cut, as shown at 69, in a generally stepped shape, to properly receive the housing 38 and feet 40 when the cover 14 is closed. Heel 72 is provided to engage the underside of lip 30 and works in combination with the toe 68 which engages the upper side of the lip, for securing the feet 40 thereto. The feet 40 may also include pins or rivets 74 which extend through each foot 40, flange 32 and again through foot 40 to thereby further secure the foot to the base 16.

Figure 3:
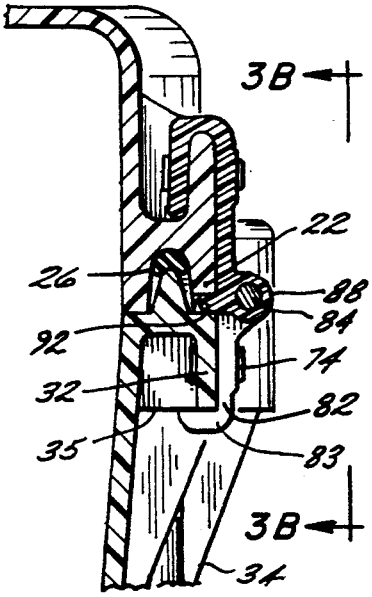
FIG. 3 is a cross-sectional elevational view taken along line 3—3 of FIG. 1.
Figure 3A:
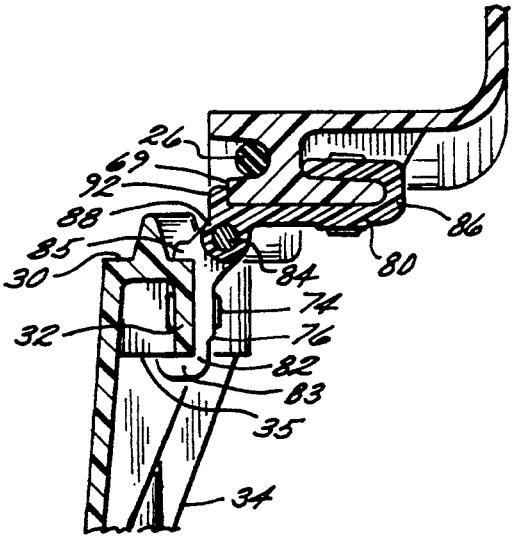
FIG. 3A is the cross-sectional elevational view of FIG. 3 with the hinge and container in the open position.
Figure 3B:
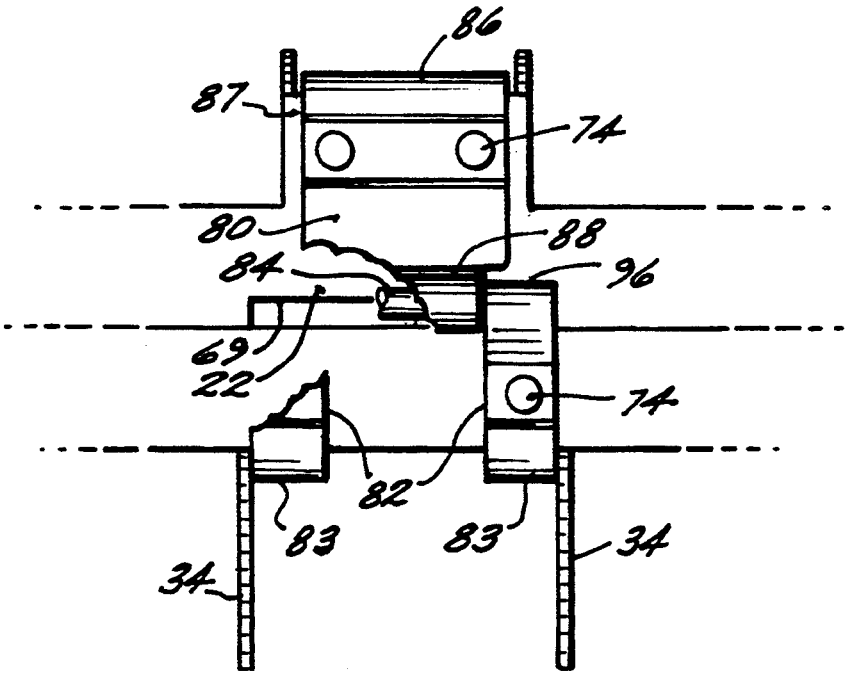
FIG. 3B is an elevational view along line 3B—3B of FIG. 3 with the hinge partially cut away.

Referring to FIGS. 1, 2, 3, 3A and 3B the hinge 10 may be formed of any suitably strong and yet light weight material such as a polycarbonate plastic and includes a strap 80 and two legs 82 extending from a hinge pin 84. The hinge pin 84 may be formed of any suitably strong and light weight material such as a polycarbonate plastic and may be molded integrally with the strap 80. The strap 80 includes a hooked upper portion 86 and a sleeve 88 for receiving hinge pin 84. Hook 86 is also adapted to engage a strike 87, which may be similar to that which is described hereinbefore, of the cover 14. Raised portion 76 is provided, as also previously described, and rivets 74 extend through strike 87 and engage hook 86. Member 92 extends from the lower edge of the strap 80 and is employed to engage the outside edge of the lip 22 which, as best shown in FIG. 3B is cut as shown at 69 to receive same. Sleeve 88 extends from the lower edge of the strap 80.

Legs 82 extend from sleeves 96, which receive hinge pin 84, and terminate in feet 83. Sleeves 96 may each be partially cored to accept a respective end of the hinge pin 84 as shown. Legs 82 are provided to ensure that feet 83 are disposed in juxtaposition with flange 32. Feet 83, as with feet 40, are shaped to receive flange 32 and also include toes 85. Toes 85 engage the upper edge of lip 30 and cut out portion 69, as previously described, allows the cover 14 to close with the toes in engagement with the lip. Heel 72 is provided to engage the lower edge of lip 30 and rivets 74 extend through back foot 83, flange 32 and the back portion of each foot 83 to further secure the lower strap to the base 16.

FIGS. 3 and 3A depict the cover 14 and hinge 10 in the closed position and then as it appears in the open position respectively. As described, the strap 80 and the feet 83 are shaped to grip the cover 14 and the base 16 in a claw like fashion.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Hinge means and latching means for a container comprising:

a container having a cover and a base, said base having a first lip defining a first mating surface, a flange extending downwardly from said lip and terminating at a lower edge, said flange having an inner face and an outer face, a plurality of support members disposed between the inner face of said flange and said base, said cover having a second lip defining a second mating surface and a plurality of strikes extending upwardly from said second mating surface;

said hinge means including a strap and a first pair of feet rotatably interconnected with said strap, a hook disposed on said strap for engaging one of said strikes, said first pair of feet each including a toe for engaging said first mating surface, said first pair of feet also engaging said flange, said strap having a portion engaged with said second mating surface;

said latching means disposed on said flange and adapted to engage one of said strikes on said cover, said latching means including a second pair of feet, each of said second pair of feet including a toe for engaging said first mating surface, a portion for engaging the lower edge of said flange and a heel for engaging the underside of said first mating surface and said inner face of said flange, a latch rotatably disposed between said second pair of feet, said latch being releasably engagable with one of said strikes on said cover.

2. The hinge means and latching means of claim 1 further including fastening means for mounting the strap to the strike and fastening means for mounting each of said first pair of feet to the flange.

3. The hinge-means and latching means of claim 2 wherein:

said strap includes a first sleeve, and a hinge pin disposed in said first sleeve; and each of said first pair of feet includes a second sleeve for receiving a portion of said hinge pin.

4. The hinge means and the latching means of claim 3 wherein:

said first pair of feet, said second pair of feet and said strap are formed of polycarbonate.

5. The hinge means and latching means of claim 1, wherein:

said first pair of feet each includes a heel to engage the underside of said first mating surface.

6. The hinge means and latching means of claim 5 further including fastening means for mounting the strap to the strike and fastening means for mounting each of said first pair of feet to the flange.

7. The hinge means and latching means of claim 6 wherein:

said strap includes a first sleeve, and a hinge pin disposed in said first sleeve; and each of said pair of feet includes a second sleeve for receiving a portion of said hinge pin.

8. The hinge means and latching means of claim 7 wherein said strap and said first pair of feet are formed of polycarbonate.

* * * * *